US006323821B1

(12) United States Patent
McLean

(10) Patent No.: US 6,323,821 B1
(45) Date of Patent: Nov. 27, 2001

(54) TOP LOADED BOW-TIE ANTENNA

(75) Inventor: James Stuart McLean, Austin, TX (US)

(73) Assignee: TDK RF Solutions, Inc., Cedar Park, TX (US)

( * ) Notice: Subject to any disclaimer, the term of this patent is extended or adjusted under 35 U.S.C. 154(b) by 0 days.

(21) Appl. No.: 09/534,397

(22) Filed: Mar. 23, 2000

Related U.S. Application Data

(60) Provisional application No. 60/126,045, filed on Mar. 23, 1999.

(51) Int. Cl.[7] ..... H01Q 9/28
(52) U.S. Cl. ..... 343/795; 343/752
(58) Field of Search ..... 343/792.5, 807, 343/808, 802, 795, 752, 821

(56) References Cited

U.S. PATENT DOCUMENTS

| | | | | |
|---|---|---|---|---|
| 5,696,372 | | 12/1997 | Grober et al. | 250/216 |
| 5,774,094 | | 6/1998 | Yonezaki | 343/770 |
| 5,926,150 | * | 7/1999 | McLean et al. | 343/846 |
| 5,977,919 | | 11/1999 | Kudo et al. | 343/713 |
| 5,986,609 | | 11/1999 | Spall | 343/702 |
| 6,057,805 | * | 5/2000 | Harrington | 343/792.5 |
| 6,154,182 | * | 11/2000 | McLean | 343/773 |

* cited by examiner

*Primary Examiner*—Don Wong
*Assistant Examiner*—Hoang Nguyen
(74) *Attorney, Agent, or Firm*—Darby & Darby

(57) ABSTRACT

A tapered, inverted-L bow-tie antenna is disclosed which includes a bow-tie antenna component connected to a central feed and having top-loading elements connected to each bow-tie half opposite the central feed. According to the invention, a series inductance is introduced between the feed and the antenna tips, and preferably at the transition between the bow-tie halves and the top-loading elements. In a preferred embodiment, the inductive loading is introduced by a buttonhook or hairpin curve in the antenna region between the bow-tie portion and the tapered portion. The added inductance reduces the capacitive reactance. The low impedance partway on stem also increases current flow, and thus the antenna's performance. The input impedance is also increased, making it easier to match the antenna to a driving hardware. The antenna can be used by itself or in combination with a log periodic dipole array.

23 Claims, 6 Drawing Sheets

TOP LOADED BOW-TIE ANTENNA

RELATED APPLICATIONS

This Application claims priority from U.S. Provisional Application Serial No. 60/126,045, filed on Mar. 23, 1999 entitled "TOP LOADED BOW-TIE ANTENNA

FIELD OF THE INVENTION

This invention is related to an improved tapered, inverted-L bow-tie antenna assembly.

BACKGROUND OF THE INVENTION

A hybrid log antenna system is an antenna system which includes a low frequency element described combined with a log periodic dipole array. In a conventional arrangement, the low frequency element is a bow-tie or Brown-Woodward Dipole antenna 10, shown schematically in FIG. 1.

A well known variant on the bow-tie antenna of FIG. 1 is the tapered, inverted-L geometry. An inverted-L geometry is obtained by taking a conventional wire dipole and bending the two straight elements to provide two L-shaped elements. This greatly reduces the overall width of the dipole while only slightly degrading the electrical performance (resonance frequency and bandwidth). Thus it provides a better performance-to-size ratio. A tapered, inverted-L geometry is obtained by taking a tapered dipole, bow-tie, or Brown-Woodward dipole and bending it into two L-shaped pieces in a similar fashion. A perspective schematic view of such a tapered, inverted-L antenna 20 is shown in FIG. 2*a*. A top view of the antenna of FIG. 2*a* is shown in FIG. 2*b*.

A problem with this antenna design, however, is the relatively large capacitive reactance, especially when compared to the resistive component of the input impedance which is exhibited by the electrically-short dipole. Another drawback to the tapered, inverted-L antenna is that matching the impedance of the antenna to the signal generator is difficult. A conventional 1.5 meter tapered, inverted L-Antenna configured to operate at a frequency of about 25 MHZ has an input impedance of around 5 ohms, making it difficult to match the antenna to components having a conventional 50 ohm input impedance. A mismatched impedance limits the efficiency and power transfer of the antenna/matching network and thus the overall efficiency of the system.

Accordingly, it would be advantageous to provide an improved tapered, inverted-L bow-tie antenna assembly which has lower capacitive reactance than conventional designs and also provides for better impedance matching.

SUMMARY OF THE INVENTION

These and other objects are achieved by a tapered, inverted-L bow-tie antenna which is modified to introduce a series inductance partway between the feed and the antenna tips, preferably at the point where the L bend occurs. In one embodiment, discrete inductors are placed at the bend between the bow-tie and the tapered portion. To avoid the structural and performance problems associated with a conventional wire coil inductor, in a more preferred embodiment, the inductive loading is introduced by a buttonhook or hairpin curve between the bow-tie portion and the tapered portion.

The buttonhook reduces the capacitive reactance and also introduces a series inductance. The low impedance partway on stem increases current flow, and thus the antenna's performance. The increase in resistance makes it easier to match the antenna to a conventional 50 ohm transmitter/receiver system. Compared to a conventional 1.5 meter antenna configured to operate at about 25 MHZ, the capacitive reactance is increased from about−200 ohms to about−100 ohms, while the input resistance is increased from about 5 ohms to about 15 ohms. In addition, the buttonhook bend does not have the structural or performance limitations associated with the use of conventional inductors.

BRIEF DESCRIPTION OF THE DRAWINGS

The foregoing and other features of the present invention will be more readily apparent from the following detailed description and drawings of illustrative embodiments of the invention in which.

DETAILED DESCRIPTION OF THE PREFERRED EMBODIMENTS

Figure 1:
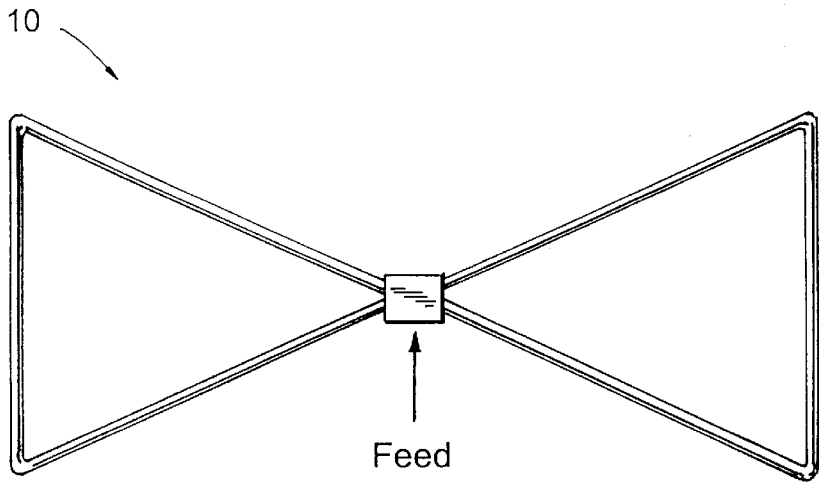
FIG. 1 (Prior Art)
FIG. 1 is a schematic diagram of a conventional bow-tie antenna.
Figure 2A:
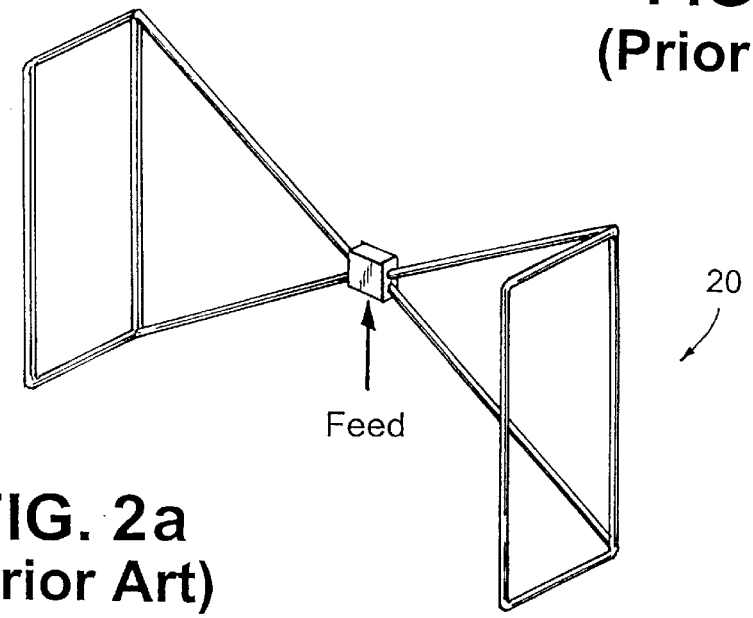
FIG. 2a (Prior Art)
FIG. 2*a* is a perspective schematic view of a conventional tapered, inverted-L antenna.
Figure 2B:
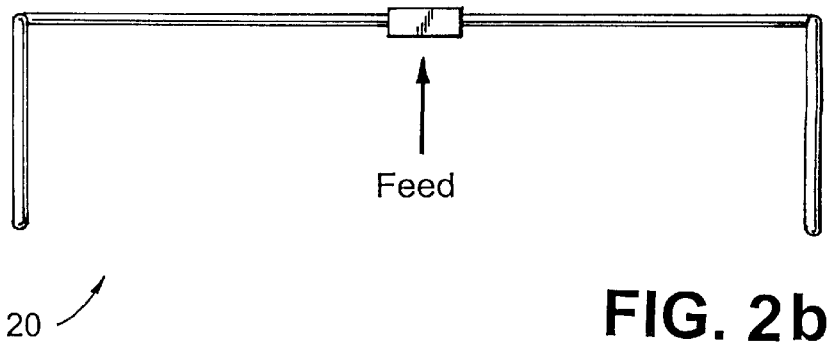
FIG. 2b (Prior Art)
FIG. 2*b* is a top view of the antenna of FIG. 2*a;*
Figure 3A:
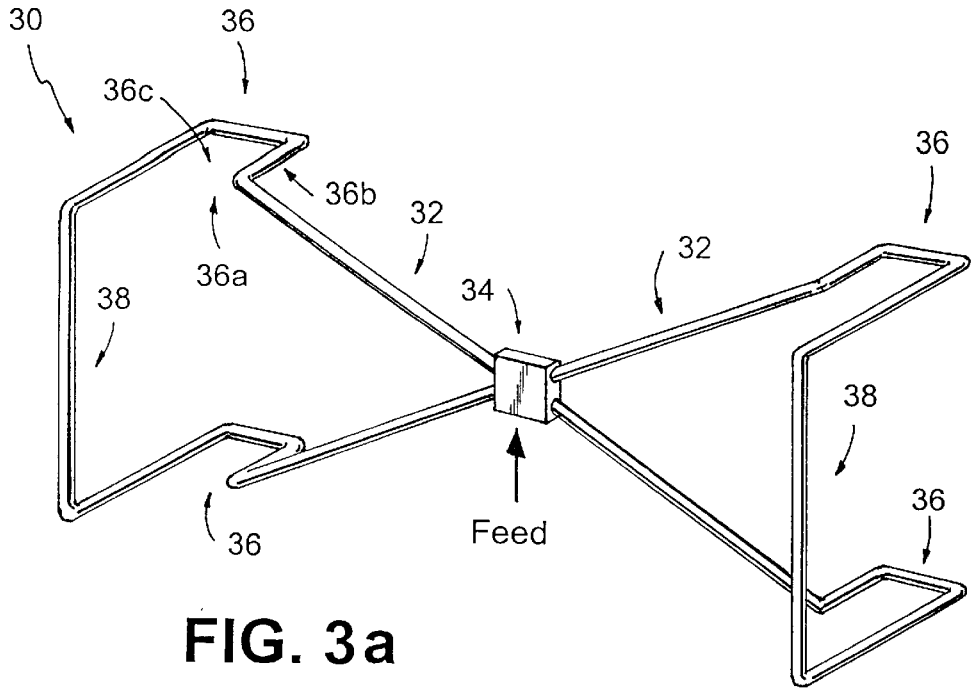
FIG. 3*a* is a perspective schematic view of an antenna according to the invention.
Figure 3B:
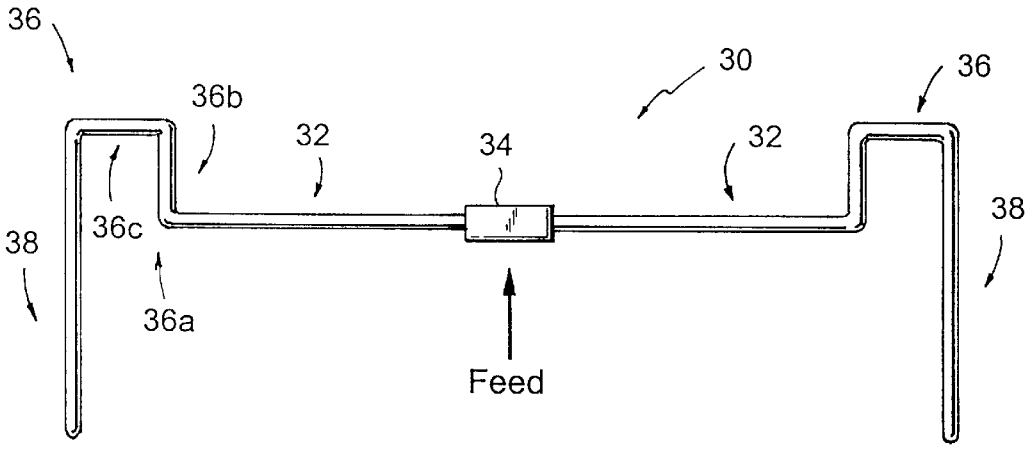
FIG. 3*b* is a top view of the antenna of FIG. 3*a;*

An improved tapered, inverted-L bow-tie antenna 30 according to the invention is illustrated in FIGS. 3*a*–3*b*. Each half of the antenna comprises a bow-tie or triangular component 32 which is connected or connectable to a central feed 34. At the end of each bow-tie component 32 and opposite the feed 34 is a buttonhook or hair-pin bend 36. As shown in the figures, each bend 36 comprises of a first bent region 36*a* of generally 90 degrees relative to the plane of the bow-tie components, a rearward extending portion 36*b*, and a second bent region 36*c* of approximately 180 degrees. As can be appreciated from the drawings, the bow-tie or triangular components 32 lie in a common plane with the central feed. Connected between the second bent regions 36*c* on each half of the bow-tie is a generally U-shaped top loading region 38 which completes the electrical circuit around the bow-tie. Although the buttonhook bends 36 are shown as having sharply defined turns, they may also be curved. In addition, while right-angle bends are illustrated, the bends may also be of other angles provided the overall button-hook configuration is generally preserved.

The buttonhook bends 36 introduce inductive loads at a point displaced from the feed 34. In addition to canceling the capacitive reactance of the electrically-small antenna, the bends 36 also increase the resistive component of the antenna's input impedance to allow a closer match to the resistive source impedance, thus making it easier to match the antenna to the transmitter and/or receiver components when compared to conventional tapered, inverted-L antennas. The amount of impedance introduced depends on the length of the rearward extending portion 36*b*. The introduced inductance is generally proportional to the length the rearward extending portion 36*b* when this length is short relative to the wavelength of interest.

Additional impedance is introduced by the top loading regions 38. In general, the further the top loading regions extend from the plane of the bowtie opposite the button hook, the greater the top-loading impedance.

Figure 3C:
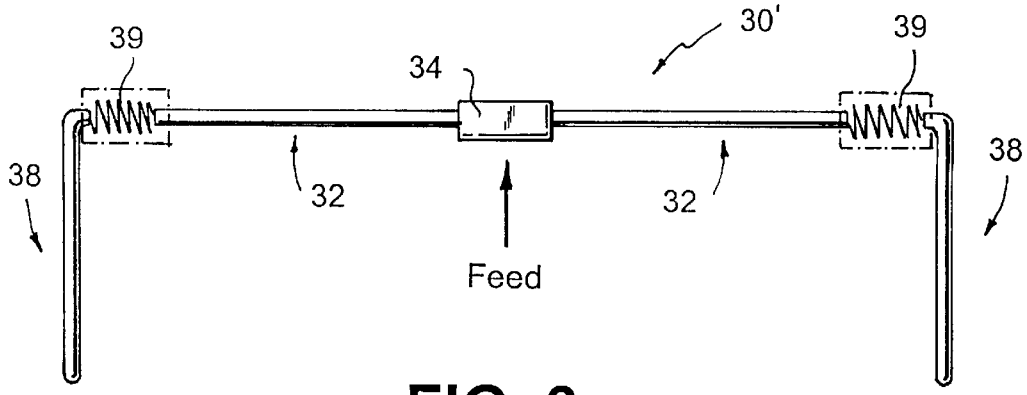
FIG. 3*c* is an alternative embodiment of an antenna according to the invention.

FIG. 3*c* is a top view of an antenna 30' according to another embodiment of the invention. As illustrated, standard wire inductors 39 are provided between each bow-tie element 32 and the top loading regions 38. Electrically, antenna 30' is equivalent to antenna 30 discussed above. Inductors 39 are contained in a suitable mechanical housing (not shown) to provide a structurally sound connection between the bow-tie elements 32 and the top loading regions 38.

Figure 4A:
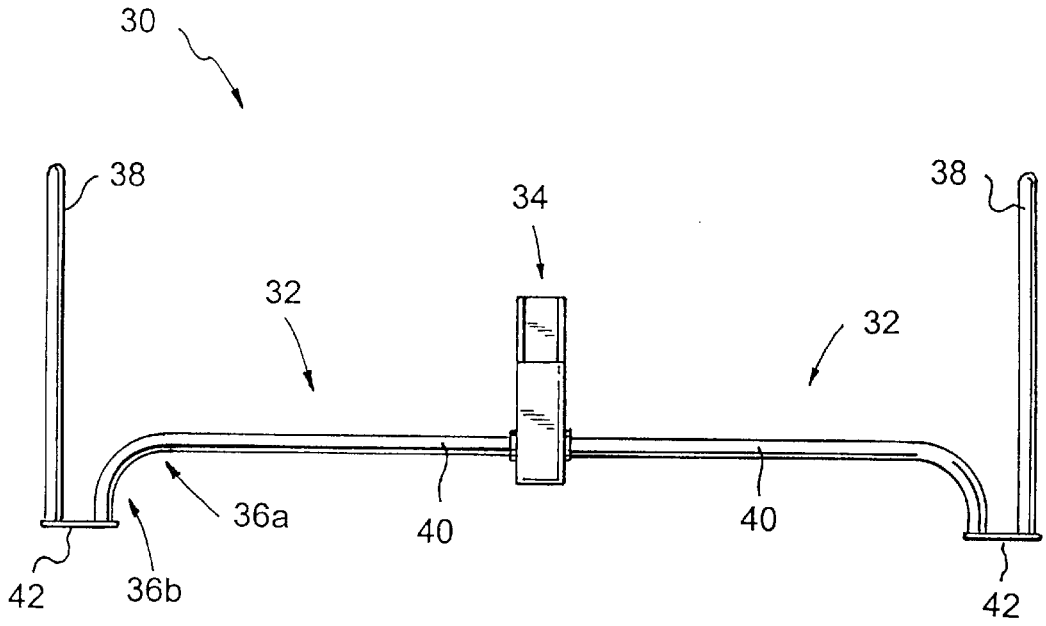
FIGS. 4*a*–4*c* are top, front, and side views, respectively, of an antenna according to the invention.
Figure 4B:
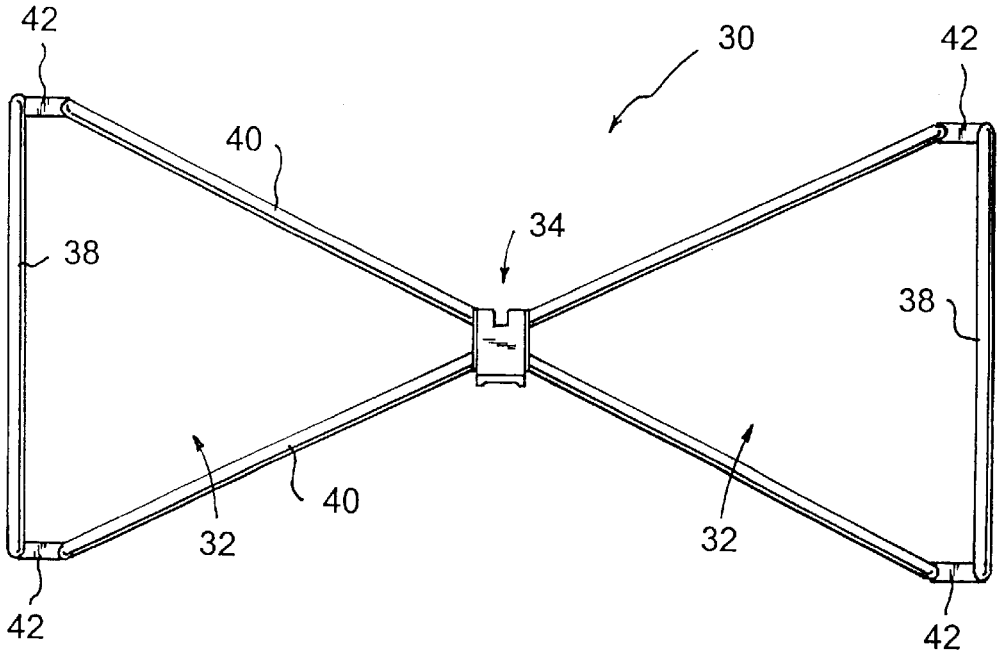
Figure 4C:
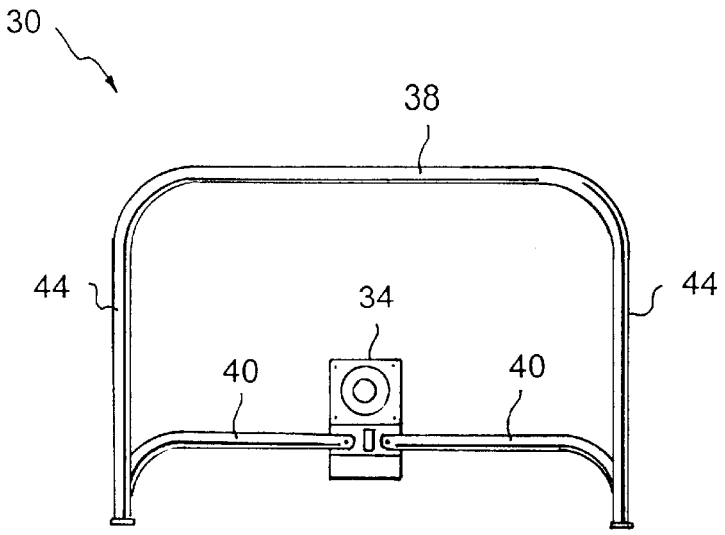

FIGS. 4*a*–4*c* are top, front, and side views respectively of a particular top loaded bow-tie antenna 30 according to the invention. The antenna comprises a pair of bow-tie components 32 affixed to a central feed 34. Each bow-tie component has a pair of edge arms 40 which terminate in a right-angle bend 36*a* and a rearward extending portion 36*b* to form generally J-shaped elements. At the end of each arm 40 opposite the feed 34 is a plate connector 42 attached at a generally right angle to extending portion 36*b*. Although plate connectors 42 may be removably connected to arms 40, preferably they are welded or otherwise permanently affixed.

U-shaped top-loading regions 38 are connected between respective pairs of plate connectors 42 as illustrated. The length of arms 44 of top-loading regions 38 determines the degree of top-loading added by the top-loading regions 38. Preferably, the top-loading regions 38 are removably connected to the plate connectors 42. This advantageously allows top-loading plates of different dimensions to be added to tune the antenna as required. In addition, removable mounting simplifies storage of the unassembled antenna.

The antenna can be constructed from aluminum tubing. However, other conductive materials can also be used. In addition, the antenna may be formed of wire, or even be of solid construction. The dimensions of the various antenna elements depend on the desired operating parameters and can be determined precisely by means of appropriate mathematical simulations without undue experimentation, as will be apparent to one of skill in the art.

Figure 5A:
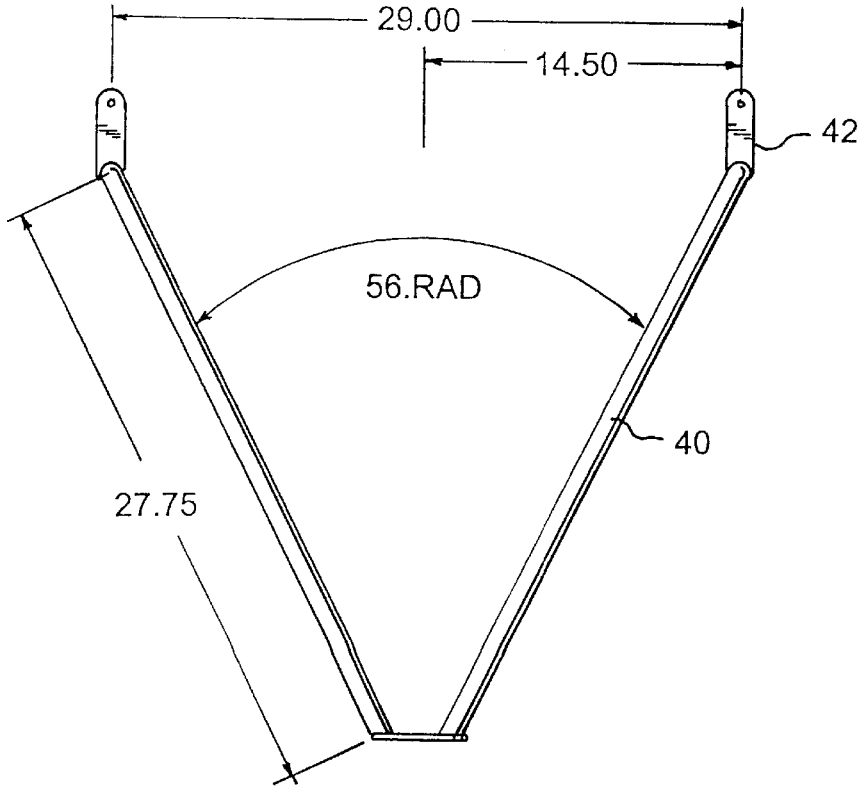
FIGS. 5*a* and 5*b* are diagrams of the various components of the antenna of FIGS. 4*a*–4*c* with relative dimensions indicated thereon.
Figure 5B:
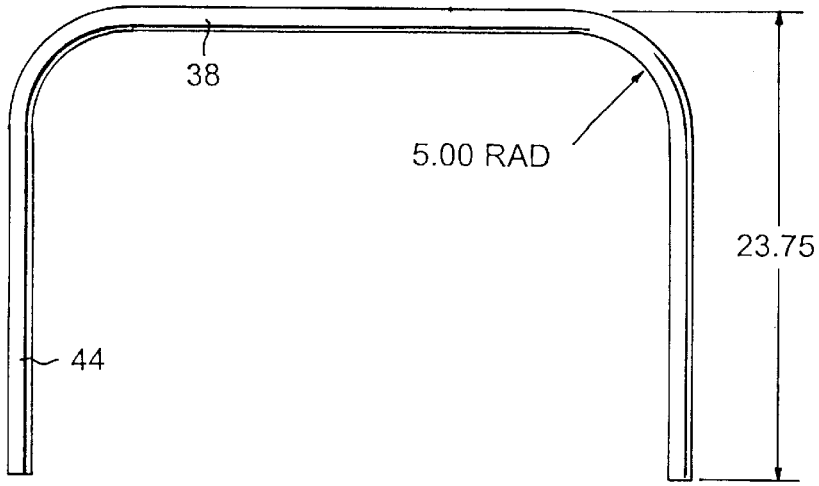

In a preferred implementation, the bow-tie element is approximately 1.5 meters in width and is configured to operate at approximately 25 MHZ. The buttonhook bends extend back from the bow-tie plane approximately 15 cm and the top loading plate extends forwards approximately 0.5 meters. Relative dimensions of the various components of a particular antenna according to the invention are illustrated in the discrete component engineering drawings shown in FIGS. 5*a* and 5*b*.

Figure 6A:
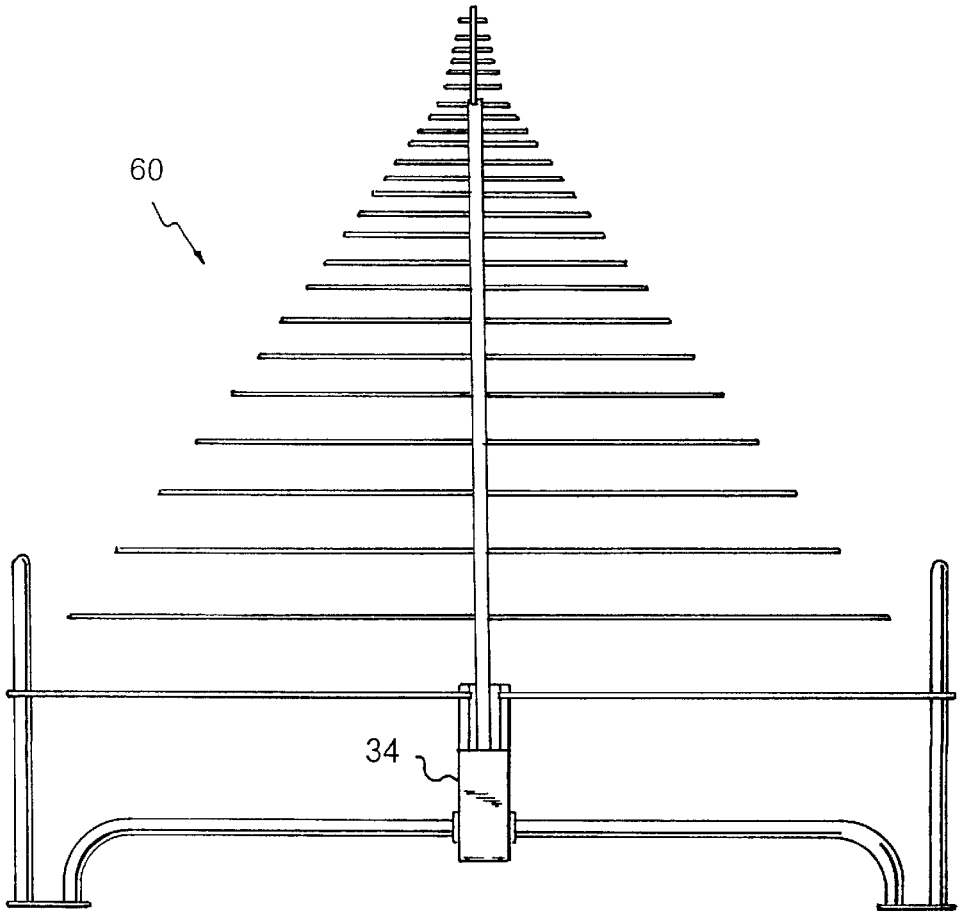
FIGS. 6*a*–6*c* are top, front, and side views, respectively, of an antenna according to the invention combined with a log periodic dipole array.
Figure 6B:
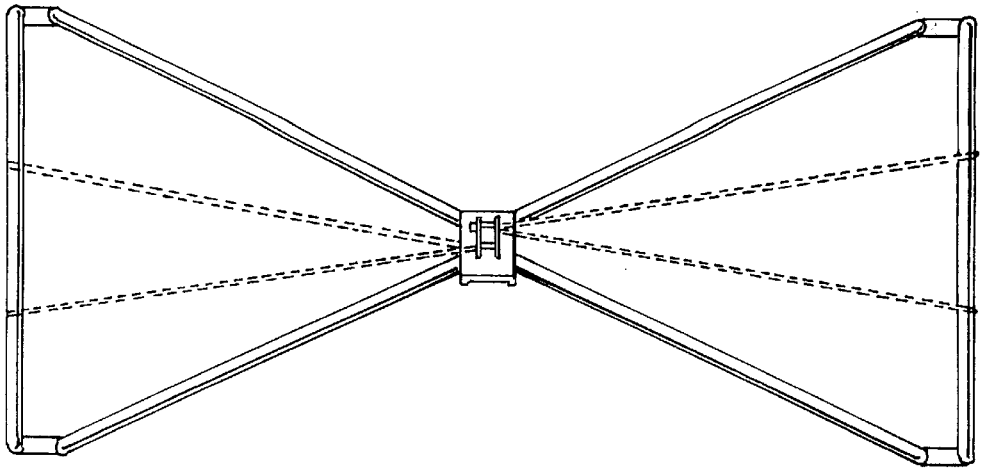
Figure 6C:
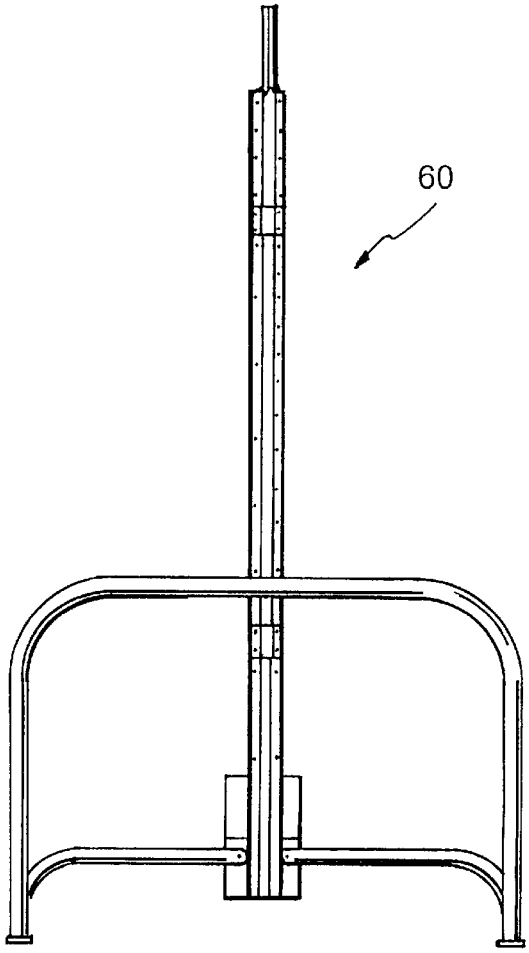

According to a further aspect of the invention, the improved tapered, inverted-L antenna is combined with a log periodic dipole array 60. FIGS. 6*a*–6*c* are top, front, and side views, respectively, of such an antenna. The dipole array is coupled to the feed using conventional techniques known to those of skill in the art. The dipole array 60 is preferably directed from the bow-tie plane in the same direction as the top-loading regions 38. This reduces the overall size of the antenna. However, the dipole can be mounted in the opposite direction if desired.

As discussed above, the present invention combines the tapered, inverted-L antenna with a geometrical modification which provides inductive loading at a point displaced from the feed. The new buttonhook design results in an input impedance which greater than conventional designs and more closely matched to that of the driving circuit, reducing losses caused by impedance mismatches and providing for greatly improved system performance. Further, in the preferred embodiment, the buttonhook design does not reduce the structural integrity of the antenna itself.

While the invention has been particularly shown and described with reference to preferred embodiments thereof, it will be understood by those skilled in the art that various changes in form and details may be made therein without departing from the spirit and scope of the invention.

What is claimed is:

1. A bow tie antenna of the type having a central feed, bow-tie components thereabout and a top loading region connected thereto comprising:

buttonhook bends extending co-linearly from the top-loading region at the junction of the top loading region and the bow-tie component.

2. A bow-tie antenna as in claim 1, wherein the buttonhook bends are orientated generally orthogonal to the bow tie components.

3. An antenna as in claim 2 wherein the top loaded antenna is generally tapered and in an inverted L shaped.

4. An antenna as in claim 3 wherein the first and second bent regions are right angle bends.

5. An antenna as in claim 3 wherein the first and second bent regions are curved.

6. An antenna as in claim 2 wherein the buttonhook bends further comprise:

a first bent region, the first bent portion generally rearwardly extending perpendicular to the first plane in the second plane;

a second bent region, the second bent region extending generally perpendicular to the first bent region in the second plane connecting the top loading region; and a rearward extending portion extending from the first bent portion and connecting the first bent region to the second bent region.

7. An antenna as in claim 2 wherein the top loading regions are substantially U-shaped.

8. An antenna as in claim 2 wherein the triangular component is approximately 1.50 meters and operates at approximately 25 MHZ, the button-hook bends extend back approximately 15.0 cm, and the top loading plate extends forward approximately 0.50 meters.

9. An antenna as in claim 2 further comprising:

a log periodic dipole array coupled to the central feed and extending in the second plane.

10. An antenna as in claim 2 wherein the antenna is constructed of a solid material.

11. An antenna as in claim 3 wherein the antenna is constructed with aluminum tubing.

12. An antenna as in claim 2 wherein the antenna is constructed with a conductive material.

13. A top-loaded bow-tie antenna introducing a series inductance before the antenna ends comprising:

a central feed;

two triangular components connected to opposing sides of the central feed and generally extending in a first plane;

a top loading region extending from the opposing ends of the two triangular components and substantially forwardly perpendicular to the first plane in a second plane; and at least two buttonhook bends generally extending rearwardly perpendicular to the first plane in a third plane at the junction of the top loading region and the triangular component.

14. A top-loaded bow-tie antenna introducing a series inductance comprising:

a central feed;

two triangular components connected to opposing sides of the central feed and generally extending in a first plane;

a top loading region extending from the opposing ends of the two triangular components and substantially forwardly perpendicular to the first plane in a second plane; and an inductor extending in the first plane from the triangular component connecting the top loading region.

15. A bow-tie antenna as in claim 14 wherein the edge arms are J-shaped.

16. A bow-tie antenna as in claim 14 wherein the plate connectors are removably connected to the edge arms.

17. A bow-tie antenna as in claim 14 wherein the top-loading regions are U-shaped.

18. A bow-tie antenna as in claim 14 wherein the top-loading regions are fixedly connected to the plate connectors.

19. An antenna as in claim 14 further comprising:

a log periodic dipole array coupled to the central feed and extending in the second plane.

20. An antenna as in claim 14 wherein the antenna is constructed of a solid material.

21. An antenna as in claim 14 wherein the antenna is constructed with aluminum tubing.

22. An antenna as in claim 14 wherein the antenna is constructed with a conductive material.

23. A top-loaded bow-tie antenna introducing a series inductance comprising:

a central feed;

two triangular components, the bow tie components connected to opposing sides of the central feed in a first plane;

an edge arm traversing the length of each triangular component, the edge arm ending in a substantially right-angle bend and having a rearward extending portion; and two plate connectors attached to the rearward extending portion of the edge arms and extending substantially perpendicular to the rearward extending portion; and a top loading region removably connected to the plate connectors and extending substantially perpendicular to the edge arms in a second plane.

* * * * *